US007234545B2

(12) United States Patent
Piñol et al.

(10) Patent No.: US 7,234,545 B2
(45) Date of Patent: Jun. 26, 2007

(54) SELF-BLOCKING SAFETY DEVICE

(76) Inventors: Hugo Luis Piñol, Roca 1167, Neuquén (AR); Oscar Fernando Gallardo, Pilar 3675, Neuquén (AR); Juan Castro, Lorenz Crease 245, Neuquén (AR)

( * ) Notice: Subject to any disclaimer, the term of this patent is extended or adjusted under 35 U.S.C. 154(b) by 0 days.

(21) Appl. No.: 10/879,866

(22) Filed: Jun. 28, 2004

(65) Prior Publication Data

US 2005/0126828 A1 Jun. 16, 2005

(30) Foreign Application Priority Data

Dec. 12, 2003 (AR) ..... P030104602

(51) Int. Cl.
*E21B 4/02* (2006.01)

(52) U.S. Cl. ..... 175/107

(58) Field of Classification Search ..... 175/92–107; 415/903; 417/223, 360
See application file for complete search history.

(56) References Cited

U.S. PATENT DOCUMENTS 4,019,592 A * 4/1977 Fox ..... 175/107
4,705,117 A * 11/1987 Warren et al. ..... 175/107
6,454,007 B1 * 9/2002 Bailey ..... 175/107

* cited by examiner

*Primary Examiner*—David Bagnell
*Assistant Examiner*—Matthew J. Smith
(74) *Attorney, Agent, or Firm*—Norris McLaughlin & Marcus, P.A.

(57) ABSTRACT

Self-blocking fishing device to be used in petroliferous well drilling tools, wherein said tools are preferably Positive Displacement Downhole Drilling Motors, Drilling mud motors, and the similar. The device includes a substantially cylindrical and hollow rod, and a sliding piece which includes an orifice for said rod to pass through, wherein the rod includes an end screwed portion for connecting the tool, whereas in a distal portion from said screwed end, said rod includes a reducing diameter zone, presenting the sliding piece an internal diameter slightly larger than the outer diameter of said rod, wherein in an lower portion of said sliding piece the inner diameter increases, including said widening at least one liquid flowing opening, being said rod and said sliding piece mutually fixed by a transversal bolt. The device allows mud to flow towards the motor zone preventing the rotor rotation in case of fault, alerting fast to the operator due to the counter-pressure abrupt falling and avoiding the increasing of breakage effect.

19 Claims, 3 Drawing Sheets

SELF-BLOCKING SAFETY DEVICE

FIELD OF THE INVENTION

The present invention refers to a self-blocking fishing device to be used in petroliferous well drilling tools, wherein these tools are preferably Positive Displacement Downhole Drilling Motors, or commonly denominated Drilling Mud Motors, and the similar.

DESCRIPTION OF THE PRIOR ART

As it is known, the only way to really know if there is petroleum underneath the terrestrial surface is drilling a hole or a well. In fact, seismic and electrical systems, geologic measurements and, new prediction and modeling formations programs, allow to determine fairly accurate the zones where exists petroleum before drilling the well. Generally, a well can be normally between 500 and 7600, or more, meters deep, depending on the region and how deep the geologic structure or formation selected by the geologists is, with possibilities of containing petroleum. The first drilling system used functioned by means of a cable. The first oil well in the U.S.A. in 1859 was perforated using this system, Chinese were first who used said system to perforate searching salt water as source for the saline industry. In this system the drilling bit is lowered and raised alternately by means of a steel cable, striking successively on the well bottom; the technique consists of perforating 1.5 to 2.4 meters, removing the tool and subsequently removing debris from the well bottom with a basket; the operation is repeated when no more debris are recovered, this kind of wells has reached 2450 meters depth.

Lately, wells were drilled by means of trepans placed in the end portion of a set (or string) of drilling bars, which simultaneously rotate the trepan and press it in the advance direction (this system is currently used). A fluid called "perforation mud" is injected through the string, said fluid is expelled out from the trepan, lubricating it, and is returned back to surface through the annular space between the perforation bar and the well, so dragging resulting pieces of drilling (cutting). Positive Displacement Downhole Drilling Motors were manufactured as further innovation, said motors are posicionated in the end portion of the string, and generate the rotatory movement of the trepan by means of pressure of drilling mud injected through said string. This allows to perforate without rotating the string or, combining a string rotation movement with the movement of a motor provided with a slightly angular coupling, manage to accurately control the direction of wells and inclusively to drill horizontal wells.

In order to better understanding what means drilling a well, oil well LAHEE classification can be observed wherein basic characteristics or purpose of each well within an area are identifiable. In this classification the well is identified according to which it is intended to do before finalizing it or according to what is found after said well is drilled and proved. In other words, it specifies wells according to the objective by which it was firstly drilled, for lately, according to results obtained, denominate it again in accordance with its commerce characteristics and geologic importance.

SUMMARY OF THE INVENTION

It is an object of the present invention to provide a self-blocking fishing device to be used in pretroliferous well drilling bottom motors (Drilling Mud Motors) which prevents that a part of the bottom motor fall in the bottom of the well if a possible fault of an outer screw of the motor occurs, forcing an operation of recovery of said portion of motor (operation of fishing). This is an expensive operation and requires long periods of time.

Other devices used in these motors that act similarly to contain the loose pieces exist, but the main difference with the one described in this disclosure, is that when the device of the present invention operates it opens a "by-pass" system, which leads the mud being injected, what results in the stopping of the motor (reason why greater damages are avoided). In addition, keeping mud flowing allows the easily extraction of the motor avoiding that the well collapses and that the motor gets clogged in the perforation. In addition, when "by-pass" is opened the operator in the surface observates an abrupt mud pressure falling, which it will indicate him that a fault has taken place and will induce him to take cautions to extract the motor.

Is therefore an object of present invention to provide a self-blocking fishing device to be used in well petroliferous drilling tools, wherein said tools are preferably Positive Displacement Downhole Drilling Motors, mud motors, and the similar, wherein the device substantially comprises a cylindrical rod and a sliding piece that includes an orifice for said rod passing through, wherein the rod includes a tool connecting end screwed portion, whereas in a portion distant to said end screwed portion said rod includes a diameter reducing zone, while the sliding piece presents an internal diameter slightly larger than the outer diameter of said rod, wherein in lower portion of said sliding piece the inner diameter increases, including said widening at least one liquid flowing opening, being said rod and said sliding piece mutually fixed by a cross-sectional bolt.

BRIEF DESCRIPTION OF DRAWINGS

For better understanding, the object of the present invention has been illustrated in several figures, it have been represented one of the preferred embodiments, being everything exemplary.

DESCRIPTION OF THE PREFERRED EMBODIMENTS

Figure 1:
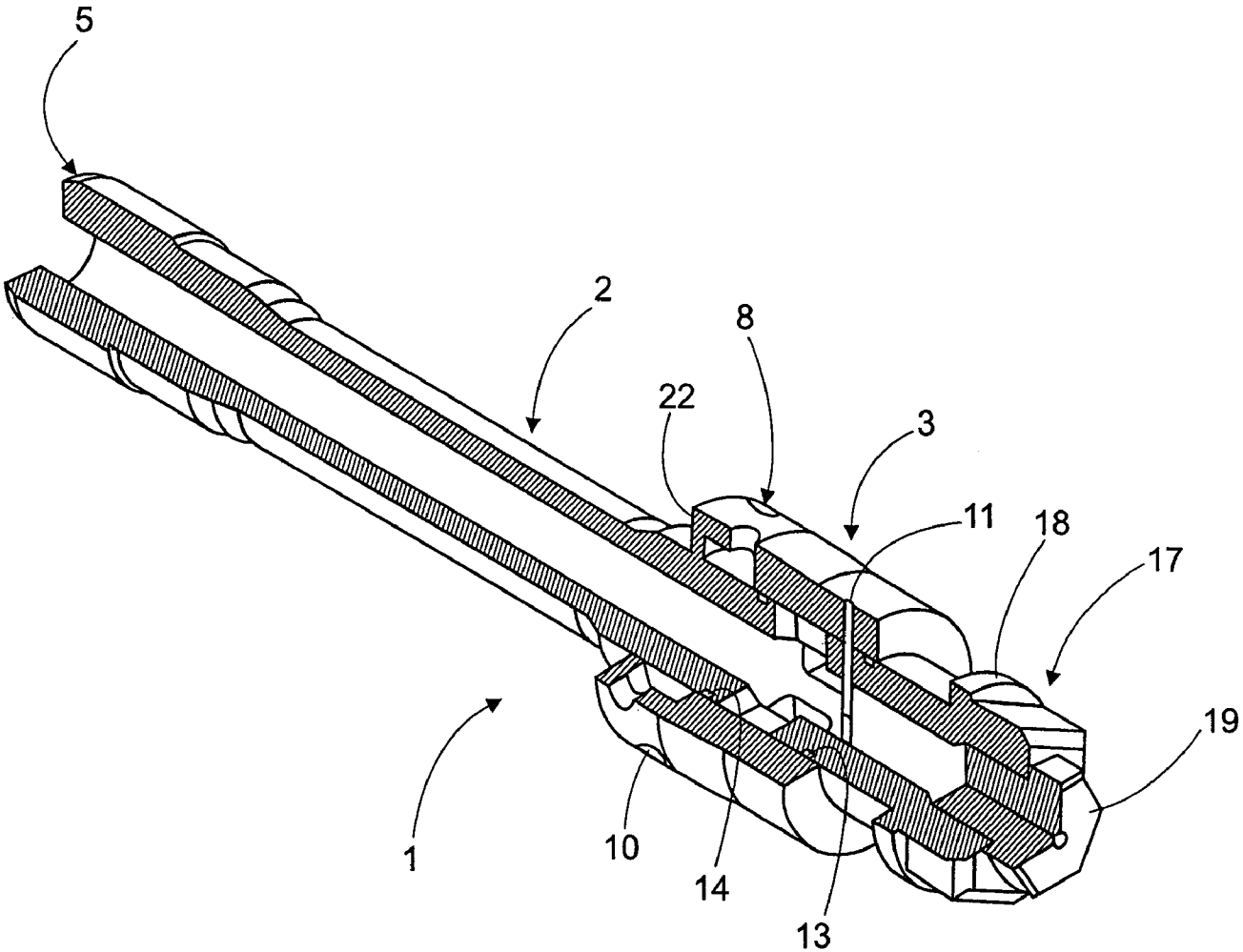
FIG. 1 is a partially cross-sectional view in perspective of the device object of the present invention.
Figure 2:
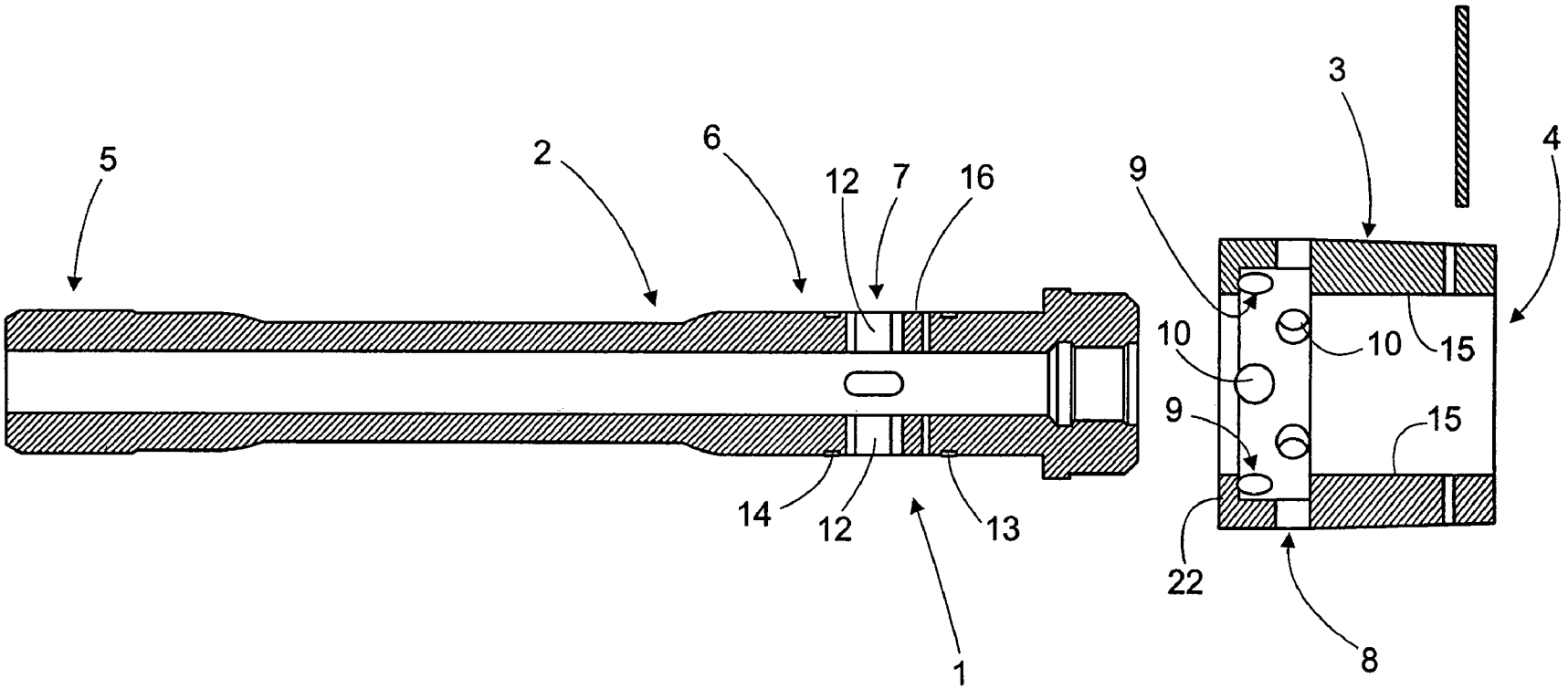
FIG. 2 is a cross-sectional and exploded view of the device of FIG. 1.

Referring firstly to FIGS. 1 and 2, the self-blocking fishing device, object of the present invention is observed, generally indicated with reference number 1, which comprises a cylindrical and substantially hollow rod 2 and one sliding piece 3 that presents an orifice 4 for said rod 2 passing trough. Rod 2 includes a screwed end portion 5 for connecting tools (not illustrated), whereas in a distal portion 6 from said end screwed portion, said rod includes a diameter-reducing zone 7.

It is possible to mention, that internal diameter of the sliding piece 3 is slightly larger than the outer diameter of said rod 2, wherein, a widening 9 of the inner diameter appears in the inferior portion 8 of said sliding piece 3, including said widening 9 at least one liquid flowing opening 10. As shown in FIG. 1, a transversal bolt 11 mutually fixes said rod 2 and said sliding piece 3.

It is important to emphasize that said diameter reducing zone 7 of said rod 2 is defined by at least four millings 12 disposed 90 degrees one each adjacent other. On the other band, said diameter reducing zone 7 includes at least an upper O'ring and a lower O'ring 14, Sliding piece 3 presents an outer surface 15 larger than surface 16 defined between said upper O'ring 13 and said lower O'ring 14.

Additionally, in this particular embodiment said at least to one opening 10 is defined by a plurality of perimetrically arranged orifices, as shown in FIGS. 1 and 2. It is possible to mention that anybody skilled in the art, in agreement with the information disclosed in this memory, will be able to appreciate that said openings 10 can be replaced by openings with any type of geometric conformation that allows the liquid to flow, as a plurality of longitudinal slots, transversal slots, diagonal slots, or the combination of said kinds of slots, being said variations contemplated by the scope of the present invention.

Referring to FIG. 1 again, rod 2 presents a diameter 18 in opposite end portion 17, larger than inner diameter of sliding piece 3. Difference between diameters prevents rod 2 to leave orifice 4 of sliding piece 3 if occurs a breakage of the tool connected to the screwed portion 5. Additionally, said end portion 17 presents a screw cap 19. This screwed cap 19 can be replaced by a nozzle (not illustrated) for drilling with high volume of liquid in by-pass modality. The perforation in by-pass modality consists of placing a nozzle that derives directly part of the mud volume towards the trepan, allowing this to circulate the well with more volume in case that this would be desirable, but avoiding the overloading of the bottom motor power part. Anyway, the effect of this by-pass nozzle, that is only partial, does not have to be confused with the total by-pass that generates the fishing device in case of operating when motor fails.

Figure 3:
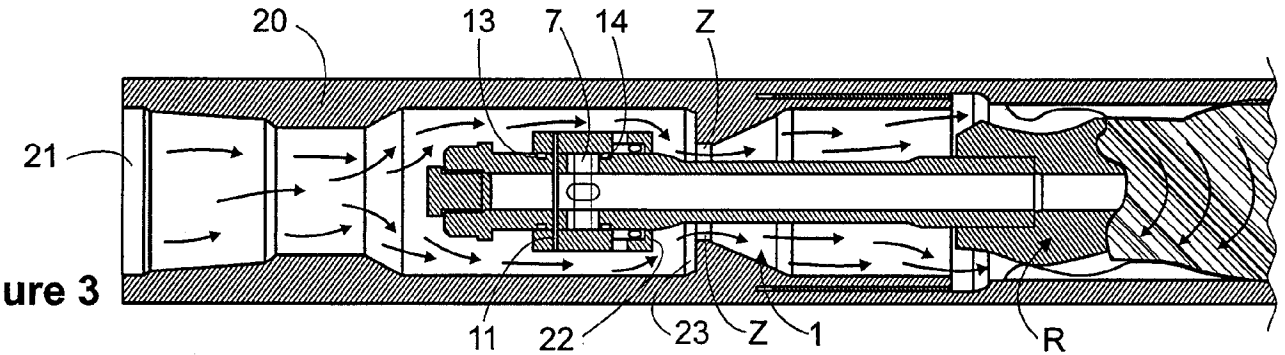
FIGS. 3, 4 and 5 show the application sequence of the device of FIG. 1.
Figure 4:
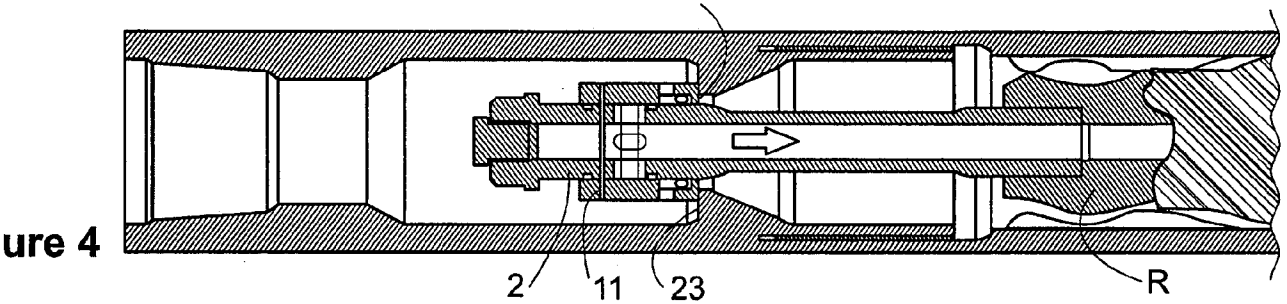
Figure 5:
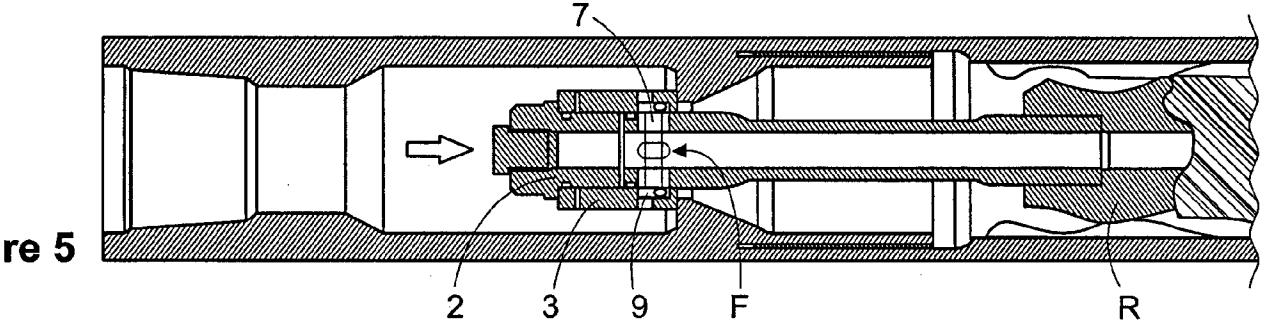

FIGS. 3 to 5 will be now referred for better interpretation of the invention, wherein the operation stages of the self-blocking fishing device fishing will be explained. In effect, FIG. 3 shows device 1 during a normal well drilling operation. As it is observed, device 1 is connected with a rotor/stator R that is commanded by the mud (indicated with arrows) which surrounds device 1 transforming the displacement energy generated by mud in mechanical energy. Mud enters by the upper portion 21 of top nut 20, flowing through the inner side of said top nut until reaching the rotor, operating this way the bottom motor or mud motor. As shown in FIG. 3, upper O'ring 13 and lower O'ring 14 prevent mud to enter into the portion of reducing section 7, avoiding this way that the displacement of piece 3 to become difficult or said piece 3 to stuck when a failure occurs.

When a failure occurs in the screw or in outer side (it is denominated as screw or outer side of screw, to screws located in the motor casing, bent housing, stator, top nut (being these pieces the basic parts of a bottom motor)), motor operates according to said failure and begins descending, as shown in FIG. 4. Motor keeps descending until base 22 of sliding piece 3 rests on seat 23 of top nut 20. As shown in FIG. 4, at the time the bottom motor breaks, mud interrupts his trajectory because zone Z where mud flows is obstructed by sliding piece 3.

Immediately after the sliding piece 3 is supported on seat 23, weight of stator R breaks transversal bolt 11, allowing rod 2 to displace downwards. As shown in FIG. 5, the diameter reducing zone 7 of said rod 2 is coincident with said diameter widening 9 of the inner diameter of sliding piece 3, defining a flow passage F. This flow passage allows mud to keep on flowing towards the base of the well, but prevents the revolving movement of rotor R.

In agreement with previously mentioned things, the main advantage of the device 1 object of the present invention at the moment when occurs a screw fault in the motor or breakage of an outer part of said motor, is that device 1 operates stopping fluid flow through the power unit, stopping this way the rotation of the motor, reducing loads and undesired vibrations on the other parts of said motor, but simultaneously allowing mud to keep on injecting to avoid for example the arising effect or the piston effect when lifting up the drilling column, leaving the well clean and avoiding crumblings while the damaged motor is extracted.

We claim:

1. Self-blocking safety device for use in petroliferous well drilling tools, the device comprising a substantially cylindrical and hollow rod and a sliding piece that includes an orifice for receiving said rod passing through the sliding piece, the rod including an end screwed portion for connecting a tool and a distal portion opposite to said end screwed portion, the distal portion including a diameter reducing zone, with the sliding piece having an inner diameter slightly larger than the outer diameter of said rod, and wherein in a lower portion of said sliding piece the inner diameter is increased, with said widening including at least one liquid flowing opening, said rod and said sliding piece being mutually fixed by a transversal bolt, and wherein said diameter reducing zone of said rod is defined by at least four millings disposed 90 degrees one each adjacent other.

2. The device according to claim 1, wherein said diameter reducing zone of said rod includes at least an upper o-ring and a lower o-ring.

3. The device according to claim 1, wherein said at least one opening is defined by a plurality of longitudinal slots, transversal slots, diagonal slots or the combination of said kinds of slots.

4. The device according to claim 1, wherein said reducing diameter zone of said rod is coincident with said diameter widening of the inner diameter of the sliding piece defines a flow passage.

5. Self-blocking safety device for use in petroliferous well drilling tools, the device comprising a substantially cylindrical and hollow rod and a sliding piece that includes an orifice for receiving said rod passing through the sliding piece, the rod including an end screwed portion for connecting a tool and a distal portion opposite to said end screwed portion, the distal portion including a diameter reducing zone, with the sliding piece having an internal diameter slightly larger than the outer diameter of said rod, and wherein in a lower portion of said sliding piece the inner diameter increases, with said widening including at least one liquid flowing opening, said rod and said sliding piece being mutually fixed by a transversal bolt, and wherein said diameter reducing zone includes at least an upper o-ring and a lower o-ring and said sliding piece has an internal surface larger than the surface defined by the zone bounded by said upper o-ring and by said lower o-ring.

6. The device according to claim 5, wherein said at least one opening is defined by a plurality of longitudinal slots, transversal slots, diagonal slots or the combination of said kinds of slots.

7. The device according to claim 5, wherein said reducing diameter zone of said rod is coincident with said diameter widening of the inner diameter of the sliding piece defines a flow passage.

8. Self-blocking safety device for use in petroliferous well drilling tools, the device comprising a substantially cylindrical and hollow rod and a sliding piece that includes an orifice for receiving said rod passing through the sliding piece, the rod including an end screwed portion for connecting a tool and a distal portion opposite to said end screwed portion, the distal portion including a diameter reducing zone, with the sliding piece having an inner diameter slightly larger than the outer diameter of said rod, and wherein in a lower portion of said sliding piece the inner diameter is increased, with said widening including at least one liquid flowing opening, said rod and said sliding piece being mutually fixed by a transversal bolt, and wherein said at least one opening is defined by a plurality of perimetral orifices.

9. The device according to claim 8, wherein said diameter reducing zone includes at least an upper o-ring and a lower o-ring.

10. The device according to claim 8, wherein said at least one opening is defined by a plurality of longitudinal slots, transversal slots, diagonal slots or the combination of said kinds of slots.

11. The device according to claim 8, wherein said reducing diameter zone of said rod is coincident with said diameter widening of the inner diameter of the sliding piece defines a flow passage.

12. Self-blocking safety device for use in petroliferous well drilling tools, the device comprising a substantially cylindrical and hollow rod and a sliding piece that includes an orifice for receiving said rod passing through the sliding piece, the rod including an end screwed portion for connecting a tool and a distal portion opposite to said end screwed portion, the distal portion including a diameter reducing zone, with the sliding piece having an inner diameter slightly larger than the outer diameter of said rod, and wherein in a lower portion of said sliding piece the inner diameter is increased, with said widening including at least one liquid flowing opening, said rod and said sliding piece being mutually fixed by a transversal bolt, and wherein the diameter of said rod in the end portion opposed to the screwed end portion is larger than the inner diameter of the sliding piece.

13. The device according to claim 12, wherein said diameter reducing zone includes at least an upper o-ring and a lower o-ring.

14. The device according to claim 12, wherein said at least one opening is defined by a plurality of longitudinal slots, transversal slots, diagonal slots or the combination of said kinds of slots.

15. The device according to claim 12, wherein said reducing diameter zone of said rod is coincident with said diameter widening of the inner diameter of the sliding piece defines a flow passage.

16. Self-blocking safety device for use in petroliferous well drilling tools, the device comprising a substantially cylindrical and hollow rod and a sliding piece that includes an orifice for receiving said rod passing through the sliding piece, the rod including an end screwed portion for connecting a tool and a distal portion opposite to said end screwed portion, the distal portion including a diameter reducing zones with the sliding piece having an inner diameter slightly larger than the outer diameter of said rod, and wherein in a lower portion of said sliding piece the inner diameter is increased, with said widening including at least one liquid flowing opening, said rod and said sliding piece being mutually fixed by a transversal bolt, and wherein said opposite end portion includes a screwed cap.

17. The device according to claim 16, wherein said diameter reducing zone includes at least an upper o-ring and a lower o-ring.

18. The device according to claim 16, wherein said at least one opening is defined by a plurality of longitudinal slots, transversal slots, diagonal slots or the combination of said kinds of slots.

19. The device according to claim 16, wherein said reducing diameter zone of said rod is coincident with said diameter widening of the inner diameter of the sliding piece defines a flow passage.

* * * * *